United States Patent [19]

Elliott et al.

[11] Patent Number: 4,795,841

[45] Date of Patent: Jan. 3, 1989

[54] PROCESS FOR UPGRADING BIOMASS PYROLYZATES

[76] Inventors: Douglas C. Elliott, 1130 Catskill; Eddie G. Baker, 514 Shaw, both of Richland, Wash. 99352

[21] Appl. No.: 33,281

[22] Filed: Apr. 2, 1987

[51] Int. Cl.[4] ..... C10B 51/00; B09B 3/00

[52] U.S. Cl. ..... 585/240; 208/412; 208/400; 208/241; 44/590; 201/2.5; 201/21; 201/25

[58] Field of Search ..... 208/412, 400; 585/240; 44/1 E; 201/2.5, 21, 25

[56] References Cited

U.S. PATENT DOCUMENTS

| | | | |
|---|---|---|---|
| 1,251,954 | 1/1918 | Billiviller | 585/240 |
| 2,220,624 | 3/1983 | Sherrard et al. | 585/240 |
| 3,997,423 | 12/1976 | Greene | 585/240 |
| 4,145,188 | 3/1979 | Espenscheid et al. | 208/400 |
| 4,152,244 | 5/1979 | Roichle et al. | 208/412 |
| 4,266,083 | 5/1981 | Huang | 585/240 |
| 4,313,011 | 1/1982 | Weil et al. | 585/240 |
| 4,336,125 | 6/1982 | Weil et al. | 208/412 |
| 4,364,745 | 12/1982 | Weil | 585/240 |
| 4,396,786 | 8/1983 | Bond et al. | 585/240 |
| 4,464,245 | 8/1984 | Hodek | 208/412 |
| 4,468,314 | 8/1984 | Rhodes et al. | 208/412 |
| 4,485,008 | 11/1984 | Maa et al. | 208/412 |
| 4,522,700 | 6/1985 | Schindler | 208/412 |
| 4,605,486 | 8/1986 | Ryan | 208/412 |
| 4,639,310 | 1/1987 | Döhler et al. | 208/412 |
| 4,670,613 | 6/1987 | Ruyter et al. | 585/240 |

FOREIGN PATENT DOCUMENTS

| | | | |
|---|---|---|---|
| 2736083 | 2/1978 | Fed. Rep. of Germany | 208/412 |
| 13803 | 2/1976 | Japan | 208/412 |

*Primary Examiner*—H. M. S. Sneed
*Assistant Examiner*—Helane Myers
*Attorney, Agent, or Firm*—Klarquist, Sparkman

[57] ABSTRACT

Pyrolyzate oil is made amendable to hydrotreatment without substantial coking problems by means of pretreatment with hydrogen at temperatures in the range of 250° to 300° C.

7 Claims, 1 Drawing Sheet

PROCESS FOR UPGRADING BIOMASS PYROLYZATES

GOVERNMENT CONTRACT

This invention was made or conceived in the course of or under a contract with the United States Department of Energy, under contract No. DE-AC06-76RLO-1830.

BACKGROUND OF THE INVENTION

This invention relates in general to processes for obtaining hydrocarbons from biomass, and more particularly to a hydrotreatment process for upgrading biomass pyrolyzates to feedstocks amenable to catalytic hydrotreatment for the production of gasoline-like fuels.

Biomass pyrolyzates do not, in general, contain a quantity or quality of hydrocarbons useful for automotive fuel or similar purposes. If these pyrolyzates are to become a useful source of hydrocarbons, they must be upgraded with additional processing such as catalytic hydrotreatment.

Unfortunately, biomass pyrolyzates are not easy to hydrotreat. When heated to typical hydrotreating temperatures, liquid biomass pyrolyzate oils tend to decompose, in a reaction that produces substantial heat, to form solid coke and non-hydrocarbon liquids.

This thermal instability problem of pyrolyzate oils has been demonstrated in numerous experiments.

We believe that undesired polymerization and coking of pyrolyzates during hydrotreatment may be caused by the presence of oxygen-containing compounds with carbonyl and ether bonds, and also by the presence of olefinic compounds.

OBJECTS OF THE INVENTION

Thus, it is the object of our invention to provide a process for pre-treating biomass pyrolyzates so that subsequent hydrotreating will not result in coking problems.

It is a further object to provide a pre-treatment process which reduces the amount of undesirable carbonyl, ether, and olefinic compounds present in pyrolyzate oils.

SUMMARY OF THE INVENTION

These and other objects are accomplished by pre-treating pyrolyzate under conditions which cause the rates of hydrogenation and thermal decomposition reactions to be of the same order of magnitude. Pyrolyzate oil is exposed to hydrogen gas and a suitable catalyst at a temperature in the range of 250° to 300° C. When pre-treated under these conditions, the pyrolyzate oil loses its ability to form coke. Oil which has been pre-treated in this way may be later hydrogenated under the high temperature conditions of conventional hydrotreatment without the occurance of substantial coking problems.

DESCRIPTION OF THE PREFERRED EMBODIMENT

Figure 1:
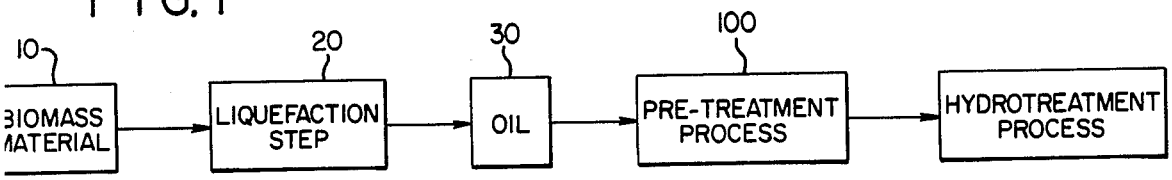
FIG. 1 is a schematic of a process for converting raw biomass to hydrocarbon product.

FIG. 1 is a schematic of a process for converting raw pyrolyzate to hydrocarbon product.

Wood chips, or other biomass material, 10 is converted to liquid 30 by means of liquefaction step 20. The composition of liquid 30 can vary greatly depending upon the conditions of production (See Table 1). If liquefaction step 20 is flash pyrolysis, a low quality oil results. Such low quality oil has a high oxygen content and is particularly disposed to coking problems when subjected to catalytic hydrotreatment. However, it is low in cost and therefore an attractive potential feedstock.

Table 2 lists the properties of two specific biomass pyrolyzate oils.

It may be seen from Table 2 that these oils are highly oxygenated and have large amounts of dissolved water. The components are a mixture of light acids, aldehydes, ketones and furans, and a larger fraction of higher molecular weight, more complexly oxygenated compounds. Many of these oxygenated compounds are lignin structure fragments including guaiacols (monomethoxyphenols) and syringols (dimethoxyphenols).

The flash pyrolyzate oils of Table 2 are thermally unstable. The batch distillation of these oils under vacuum proceeds routinely until a pot temperature of 170–200 C. is attained, at which point a strongly exothermic reaction occurs, and the bubbling oil solidifies into sponge-like coke. This phenomenon is totally unlike the distillation of high-pressure liquefaction oils which proceeds to temperatures of 300 C. or greater without coking of the distillation residue. It has been found that these flash pyrolyzate oils will decompose to a solid and a water solution when heated to 270 C. under inert gas. This effect has been observed for whole oils as well as oil distillates, a water-washed oil, and a sodium corbonate extracted (acid-free) oil.

The thermal instability of the flash pyrolyzate oil causes these oils to form coke when subjected to conventional hydrotereatment. However, the pre-treatment process described hereafter may be used to eliminate this coking problem.

Liquid 30 is the raw material input into the pre-treatment process 100.

TABLE 1

Properties of Biomass Liquefaction Products

| | High-Pressure Liquefaction | Flash Pyrolysis |
|---|---|---|
| carbon content | 68–81% | 56–66% |
| sulfur & nitrogen content | 0.1% | 0.1% |
| oxygen content (maf) | 9–25% | 27–38% |
| water in crude | 6–25% | 24–52% |
| viscosity | 2900 cP @ 40° C.–55,000 cP @ 60° C. | 5–59 cp @ 40° C. |
| density, g/ml | 1.10–1.14 | 1.11–1.23 |

TABLE 2

Properties of Pyrolysis Oil Feedstocks

| | Georgia Tech | | Waterloo | |
|---|---|---|---|---|
| | As Fed | Dry | As Fed | Dry |
| Carbon, % | 39.5 | 55.8 | 49.8 | 65.9 |
| Hydrogen, % | 7.5 | 6.1 | 7.3 | 6.1 |
| Oxygen, % | 52.6 | 37.9 | 42.8 | 28.0 |
| Nitrogen, % | <0.1 | <0.1 | <0.1 | <0.1 |
| Ash, % | 0.2 | 0.3 | 0.03 | 0.04 |
| Moisture, % | 29 | 0 | 24.3 | 0 |

TABLE 2-continued

| Properties of Pyrolysis Oil Feedstocks | Georgia Tech | | Waterloo | |
|---|---|---|---|---|
| | As Fed | Dry | As Fed | Dry |
| Density @ 55° C. | 1.23 | — | 1.11 | — |

Figure 2:
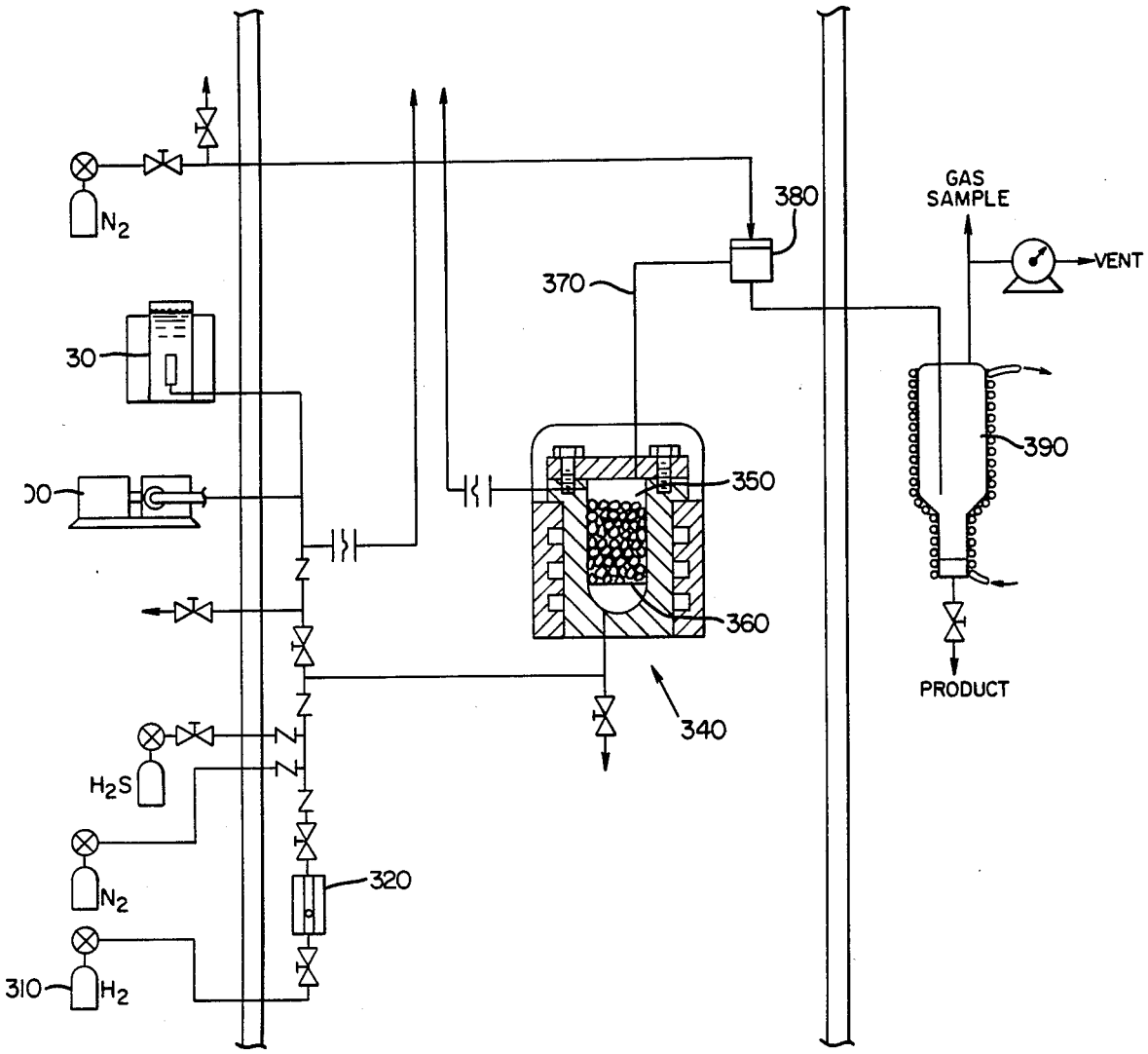
FIG. 2 is a diagram of a reactor system in which the pre-treatment process has been demonstrated.

The pre-treatment process has been demonstrated using the continuous-feed, fixed-bed catalyst system as shown in FIG. 2. The wood-derived oil 30, preheated to about 40 C., is pumped by high-pressure metering pump 300. Hydrogen from high-pressure cylinder 310 is metered through rotameter 320 and mixed with oil prior to entering reaction vessel 340. Reaction vessel 340 is a thick-walled stainless steel vessel approximately 7.5 cm internal diameter by 25 cm high. It holds about 900 ml of catalyst pellets 350 supported by stainless steel screen 360. The void volume of vessel 340 when charged with catalyst is approximately 650 ml.

Our calculations indicate that for the liquid and gas flow rates used in our tests a two-phase flow pattern exists in reaction vessel 340. Liquid moves through the reactor very slowly, essentially plug flow. Gas flows through more rapidly, bubbling through the oil. Light products are removed in the gas phase with the hydrogen. There is essentially no carryover of the liquid with the gas until the liquid level reaches the top of the reactor and overflows into product line 370. The pressure within the system is maintained by a Grove valve back-pressure regulator 380. Liquid product is recovered in knock-out pot 390 and the offgas is metered and analyzed before it is vented.

Low temperature operating conditions prove effective in allowing stable operations in this reaction system. The product of this low temperature pre-treatment is amenable to high temperature hydrotreatment with reduced coking problems. Table 3 provides a list of important operating conditions for a series of tests over the temperature range from 250 C. to 310 C. Operation of the system at temperatures much above 300 C. led to excessive thermal decomposition and plugging in the catalytic bed.

The processing results from these tests show that this temperature range is the critical range in the balance of catalytic hydrogenation and thermal decomposition of the pyrolyzates. The low temperature test at 258 C. proceeded smoothly. It produced a relatively uniform product oil and resulted in only minor amounts of char formation in the catalyst bed. The carbon loading on the catalyst varied from 5.5 to 10 percent at the end of the test. The bulk of the carbon missing in the carbon balance is suspected to have been product oil which was unknowingly washed from the product letdown train during system cleanup following the test.

The middle temperature test at 280 C. also proceeded smoothly, however, a lighter more deoxygenated product was recovered earlier in the run before the heavier components reached the knock-out pot. This product variation represents the more hydrotreated components which were produced at higher temperature and which traveled out of the reaction vessel more readily due to their greater volatility and the higher temperature of operation. A pressure drop across the reaction vessel developed during the run which indicated a partial blockage of the system. However, the pressure drop dissipated later in the run and the experiment was terminated voluntarily. A much larger amount of char material was found in the partially hydrotreated oil left in the reaction vessel following this test. The catalyst pellets carried a higher carbon loading (7–13%) although the total amount of carbon as a percent of feed carbon was about the same as in the 258 C. test.

In the high temperature test at 310 C. the reaction vessel eventually plugged and the experiment had to be terminated. The product oil recovered during this test was of a better quality than even the lighter products from the 280 C. test. At the end of this test the catalyst bed was completely encased in a brittle, high melting polymer material. The interpretation of this result is that the thermal decomposition leading to coking of the pyrolyzate proceeds at a greater rate than the catalytic hydrogenation process at 310 C. Carbon conversion to gas at 310 C. was the highest in any of the three tests.

These tests indicate that biomass pyrolyzates will polymerize to form coke at a rate high enough to plug a chemical reactor if they are hydrogenated at a temperature above a certain limit. This temperature, which we have found to be in the neighborhood above 310 C., can be referred to as the "coke polymerization temperature". We have found that hydrogenation of the pyrolyzate can be accomplished below this coke polymerization temperature, and, moreover, that this hydrogenation will result in a product with a coke polymerization temperature higher than that of the input material. This increase in the coke polymerization temperature permits later hydrogenation steps to take place at a high temperature without the occurance of coking problems.

The coke polymerization temperature is defined with respect to a certain reference polymerization rate. It is that temperature above which a given oil in a given reactor system causes coking problems severe enough to prevent normal operation of the reactor. It is thus a practical yardstick, rather than a physical constant.

TABLE 3

| Hydrotreating Test Results with Georgia Tech Pyrolyzate | | | |
|---|---|---|---|
| Experimental Operating Conditions | | | |
| Catalyst | nickel | nickel | nickel |
| Temperature, °C. | 258 | 280 | 310 |
| Pressure, PSIG | 2020 | 2050 | 2050 |
| Oil feed rate, ml/hr | 290 | 396 | 405 |
| Hydrogen rate, L/hr | 168 | 216 | 240 |
| LHSV, vol oil/vol cat/hr | 0.32 | 0.44 | 0.45 |
| Hydrogen consumption, L/L oil | 66 | 161 | 252 |
| Experimental Results and Product Analyses | | | |
| Carbon conversion, wt % | | | |
| to oil/aqueous | 36/14 | 57/10 | 0/5 |
| to gas ($C_1$ to $C_4$) | 9 | 11 | 16 |
| to carbon on catalyst | 9 | 8 | — |
| Oil product yield, ml/ml feed | 0.28 | 0.42 | reactor plugged |
| Carbon balance (based on oil/aqueous/gas) | 59 | 78 | — |
| Hydrogen balance | 91 | 100 | — |
| Oxygen balance | 100 | 102 | — |
| Overall mass balance | 84 | 96 | — |
| Total oil feed, ml | 1601 | 1737 | 2026 |
| Wet product analysis | | | |
| H/C, atomic | 1.54 | 1.42 | 1.49/1.63 |
| oxygen, percent | 26.8 | 25.0 | 19.4/13.2 |
| density, g/ml | 1.1 | — | —/0.96 |

The result with the nickel catalyst at 310 C. (plugged reaction vessel) was similar to that achieved at higher temperature with the cobalt-molybdenum catalyst. In order to provide a more direct comparison of the two catalysts, tests were undertaken with sulfided cobalt-molybdenum catalyst at lower temperatures. As shown in Table 4, in nearly all respects the nickel catalyzed tests provided the same results as the cobalt-molybdenum catalyzed tests.

A single test with alumina balls in place of alumina-supported metal demonstrated that the catalytic entity is important to the process. With only alumina in the bed (results in Table 4) the reaction vessel plugged almost immediately. Only limited amounts of water and heavy oil product (24–28% oxygen) were recovered prior to the system plugging. A coke-like material (Hydrogen to carbon atomic ratio 1.04) was recovered from the bottom one-third of the reactor. We conclude that although the net hydrogen consumption in the metal catalyzed tests was relatively small, the metal catalyst must play a key role in interrupting the thermal decomposition/polymerization of the pyrolyzate, probably by hydrogenating active intermediates.

Since the thermal decomposition reactions are perceived to be relatively fast reactions and since little catalytic hydrogenation appears to be occurring in the reaction vessel (as measured by hydrogen consumption) it was recognized that the length of time in the reaction vessel might play a relatively minor role in this processing. Indeed, as the data in Table 5 shows, there is almost no effect on the product quality as a function of residence time. As the residence time is reduced from 86 minutes to 23 minutes the oxygen content and hydrogen to carbon ratio of the products remains almost unchanged. The differences in the product quality numbers in Table 5 are explained by minor differences (±2%) of water dissolved or emulsified in the product oils. The initial abrupt change in oxygen content of the product tar in going from 86 to 66 minutes is thought to be related to the hydrogen partial pressure change. Changes which are noticeable as a function of residence time are the decrease in gas production and increase in oil product recovery as the residence time decreases. Coincidentally, the amount of oxygen rejection from the oil phase also decreases. These results suggest that the low temperature hydrotreating to upgrade pyrolyzates can be accomplished with relatively fast throughputs and residence times of 23 minutes or less.

TABLE 4

Additional Hydrotreating Test Results

| | | |
|---|---|---|
| **Experimental Operating Conditions** | | |
| Catalyst | CoMo | Alumina |
| Temperature, °C. | 273 | 254 |
| Pressure, psig | 2025 | 2000 |
| Oil feed rate, ml/hr | 392 | 411 |
| Hydrogen rate, L/hr | 168 | 180 |
| LHSV, vol oil/vol cat/hr | 0.44 | 0.46 |
| **Experimental Results and Product Analyses** | | |
| Hydrogen consumption, L/L oil | 135 | −49 |
| Carbon Conversion, wt % | | |
| to oil/aqueous | 55/11 | — |
| to gas ($C_1$ to $C_4$) | 9 | 10 |
| Oil product yield, ml/ml feed | 0.42 | reactor plugged |
| Carbon balance (based on oil/aqueous/gas) | 70 | — |
| Hydrogen balance | 96 | — |
| Oxygen balance | 104 | — |
| Overall mass balance | 91 | — |
| Total oil feed, ml | 1794 | 753 |
| Wet Product Analysis | | |
| H/C atomic | 1.47 | 1.14 |
| oxygen, percent | 24.6 | 24.9 |

TABLE 5

Hydrotreating Results as a Function of Residence Time

| | | | | | | |
|---|---|---|---|---|---|---|
| **Experimental Operating Conditions** | | | | | | |
| Catalyst | CoMo | CoMo | CoMo | CoMo | CoMo | CoMo |
| Temperature, °C. | 273 | 271 | 271 | 274 | 271 | 270 |
| Pressure, psig | 2025 | 2020 | 2020 | 2010 | 2030 | 2040 |
| Oil feed rate, ml/hr | 392 | 515 | 555 | 935 | 1200 | 1440 |
| Hydrogen rate, L/hr | 168 | 120 | 120 | 120 | 120 | 120 |
| LHSV, vol oil/vol cat/hr | 0.44 | 0.57 | 0.62 | 1.04 | 1.33 | 1.60 |
| Residence Time, min | 86 | 66 | 61 | 37 | 28 | 23 |
| **Experimental Results and Product Analyses** | | | | | | |
| Hydrogen consumption, L/L oil | 135 | 90 | 60 | 39 | 32 | 28 |
| Carbon Conversion, wt % | | | | | | |
| to oil/aqueous | 82/11 | 80/10 | 87/8 | 83/5 | 83/7 | 87/11 |
| to gas ($C_1$ to $C_4$) | 9 | 7 | 7 | 5 | 4 | 4 |
| Oil product yield, ml/ml feed | 0.52 | 0.56 | 0.69 | 0.66 | 0.65 | 0.70 |
| Carbon balance | 100 | 97 | 102 | 93 | 94 | 102 |
| Hydrogen balance | 103 | 104 | 97 | 81 | 81 | 96 |
| Oxygen balance | 100 | 99 | 100 | 76 | 77 | 97 |
| Overall mass balance | 100 | 98 | 101 | 83 | 84 | 99 |
| Total oil feed, ml | 1794 | 3860 | 3890 | 2683 | 1872 | 2123 |
| Wet Product Analysis | | | | | | |
| H/C atomic | 1.47 | 1.47 | 1.56 | 1.56 | 1.48 | 1.58 |
| oxygen, percent | 24.6 | 30.8 | 32.7 | 32.7 | 31.4 | 34.2 |
| Oxygen rejection, % | 79 | 70 | 57 | 59 | 62 | 55 |

A series of experimental conditions were tested in order to evaluate the need for adding hydrogen to the reaction vessel. This series of experiments was performed at the highest oil flow rate tested in the previous section. In the series, the hydrogen flow was reduced in steps to zero then the pressure maintained in the reaction vessel was reduced in steps to only 100 psig. Operations continued successfully throughout the series of conditions without coking and plugging of the reaction vessel until the experiment was terminated and oil flow was stopped. At that point a combination of the thermal inertia in the heaters and exothermic reactions in the vessel led to a temperature increase of over 50° C. and the oil in the vessel coked to a solid.

In addition to the product quality data given in Table 6 there were other indicators of a general product quality loss as the amount of hydrogen in the system was reduced. The viscosity of the product increased from 14,200 centipoise @ 60 C. for the products at the higher hydrogen flows to 18,700 centipoise @ 60 C. for product with low hydrogen flow to 32,700 centipoise @ 60

C. for the product with no hydrogen flow. These viscosities range upward from those measured for the high-pressure oils and are about three orders of magnitude higher than the viscosity measured for the crude pyrolysis oil. An increase in density was also found to correlate with the reduction in hydrogen flow. Densities increased from 1.14 to 1.16 to 1.18 g/ml @ 20° C. for the products of higher flow, lower flow and no flow of hydrogen, respectively. These densities again range upward from that measured for a high-pressure oil while remaining less than the typical density of a pyrolysis oil.

Hydrotreatment to Gasoline

The results given above indicate that the low-temperature catalytic treatment of pyrolyzate transforms the primary pyrolyzate oils into a chemical composition similar to that of the high-pressure oils.

Product Potential for Catalytic Hydrotreatment

The 258° C. product has been distilled to recover 2% light hydrocarbon, 29% distillate and 59% residual material with 9.5% water dissolved in the oil. The distillation was taken to an endpoint of 205° C. @ 20 mmHg. The presence of small water droplets in the condensate at temperatures approaching the end point indicated that thermal cracking of the oil was occurring and the distillation was terminated. The residual material was still fluid and had not coked at a pot temperature of 280° C. This behavior contrasts sharply with the thermal decomposition and coke formation at less than 200° C. experienced with the pyrolyzate feedstock and is more similar to the behavior of the high-pressure oils.

TABLE 6

Hydrotreating Results as a Function of Hydrogen Flow

| Experimental Operating Conditions | | | | |
|---|---|---|---|---|
| Catalyst | CoMo | CoMo | CoMo | CoMo |
| Temperature, °C. | 270 | 277 | 276 | 268 |
| Pressure, psig | 2040 | 2028 | 2010 | 200 |
| Oil feed rate, ml/hr | 1440 | 934 | 959 | 1062 |
| Hydrogen rate, L/hr | 120 | 40 | 0 | 0 |
| LHSV, vol oil/vol cat/hr | 1.60 | 1.04 | 1.07 | 1.18 |
| Residence time, min | 23 | 37 | 37 | 33 |
| Experimental Results and Product Analyses | | | | |
| Hydrogen consumption, L/L oil | 28 | 26 | 0 | 0 |
| Carbon Conversion, wt % | | | | |
| to oil/aqueous | 87/11 | 83/9 | 85/7 | 85/10 |
| to gas ($C_1$ to $C_4$) | 4 | 10 | 10 | 5 |
| Oil product yield, ml/ml feed | 0.70 | 0.61 | 0.61 | 0.68 |
| Carbon balance | 102 | 102 | 103 | 100 |
| Hydrogen balance | 96 | 92 | 92 | 101 |
| Oxygen balance | 97 | 97 | 94 | 99 |
| Overall mass balance | 99 | 99 | 98 | 100 |
| Total oil feed, ml | 2123 | 1900 | 1618 | 1300 |
| Wet Product Analysis | | | | |
| H/C atomic | 1.58 | 1.44 | 1.33 | 1.62 |
| oxygen, percent | 34.2 | 30.7 | 29.5 | 35.8 |
| Oxygen rejection, % | 55 | 61 | 62 | 48 |

The thermal stability of the low-temperature, hydrotreated product oil as well as its elemental composition (70.7%C, 8.1%H, 0.1%N, 20.9%O, calculated to a dry basis) indicate that it has been significantly upgraded from the original pyrolyzate. Chemical composition analysis by gas chromatograph and mass spectroscopy was performed on one sample and the identified components are listed in Table 7. The carbonyl side chains which could be a major source of polymerization of the phenolics have been destroyed. Unsaturated alkyl side chains (propenyl) have been saturated. The relative amount of phenolic material appears to have increased at the expense of the phenolic ethers. Saturated cyclic alcohols (cyclohexanols) are also present indicating some hydrogenation of the aromatic rings. Also detected were pure hydrocarbon compounds such as the tetralins (tetrahydronaphthalenes). The acid component is largely removed into the aqueous phase and will no longer interfere in the hydrotreating process. Based on these chemical changes it is concluded that pyrolyzate pre-treated with our process can be further processed at higher temperatures by more conventional hydrotreating techniques to produce hydrocarbon fuels.

TABLE 7

Components Identified in Low-Temperature Hydrotreated Pyrolyzate

| Major* | Minor* |
|---|---|
| dimethoxyphenol (syringol) | methylcyclohexanol (2 isomers) |
| hydroxymethoxybenzoic acid | methylphenols (3 isomers) |
| propylsyringol | ethylphenols (2 isomers) |
| ethylsyringol | dimethylphenol |
| propylguaiacol | phenol |
| methylguaiacol | cyclohexandiol (2 isomers) |
| ethylguaiacol | methyltetralins (4 isomers) |
| methoxyphenol (guaiacol) | ethyl/dimethyl tetralins |
| cyclohexanol | (2 isomers) |
| | 3 and 4 carbon substituted |
| | phenols (4 isomers) |
| | indan |

*based on relative areas of flame ionization detector peaks, not strictly quantified.

Thus, a useful pre-treatment process for upgrading biomass pyrolyzates to a usable feedstock is herein disclosed. A two-step hydrotreating process converts wood pyrolyzate first to a more thermally-stable tar and then to the hydrotreated gasoline product. The pre-treatment step is performed at lower temperatures and pressures. Hydrogen consumption is relatively low but the combination of thermal reactions and catalytic reactions is sufficient to transform the pyrolyzate in high yields into a useful feedstock for higher temperature catalytic hydrotreatment to gasoline.

The product yield from this low-temperature hydrotreatment is 85% on a carbon basis with the carbon losses primarily as water-soluble organics and carbon dioxide gas. The second hydrotreatment step to gasoline has a similar yield on a carbon basis with the losses confined almost exclusively to the gas phase, mostly as hydrocarbon gases. The gasoline product from this type of hydrotreatment consists of cyclic and aromatic compounds.

The foregong description of a preferred embodiment of the invention has been presented for purposes of illustration and description and is not intended to limit the invention to the precise form disclosed. It is intended that the scope of the invention be defined by the following claims:

We claim:

1. A method for treating biomass pyrolyzates produced by flash pyrolysis, which pyrolyzates have a certain coke polymerization temperature, in order to reduce the tendency toward coke formation, comprising the step of:

hydrogenating said pyrolyzates at a temperature below said coke polymerization temperature.

2. The method of claim 1 wherein said treatment temperature is in the range of 250 to 300 C.

3. The method of claim 2 wherein said hydrogenating step is accomplished in conjunction with a hydrogenation catalyst.

4. The method of claim 3 wherein said catalyst is selected from the group containing: CoMo and Ni.

5. A treated biomass pyrolyzate oil having an increased coke polymerization temperature which is prepared from untreated pyrolyzate oil by means of hydrogenation at a temperature below the coke polymerization temperature of said untreated oil, wherein the untreated pyrolyzate oil was produced by flash pyrolysis.

6. A method for treating biomass pyrolyzates produced by flash pyrolysis intended to make them suitable for high temperature catalytic hydrogenation with reduced incidence of coking problems, comprising the step of:

hydrogenating said pyrolyzates at a treatment temperature high enough to be effective for allowing hydrogenation to proceed yet too low to be effective for inducing rapid polymerization of the pyroyzate.

7. The method of claim 6 wherein said treatment temperature is in the range of 250 C. to 300 C.

* * * * *